US005116204A

United States Patent [19]

Power et al.

[11] Patent Number: 5,116,204

[45] Date of Patent: May 26, 1992

[54] DISPLAY DEVICE

[76] Inventors: Peter A. Power, Carrobeg, Burrow Road, Portrane, County Dublin; Adrian P. Power, 47 Hollybrook Road, Clontarf, Dublin 3; Julian M. Power, 49 Lein Road, Artane, Dublin 5; David Conlon, "Primavera", Brighton Road, Foxrock, Dublin 18, all of Ireland

[21] Appl. No.: 577,364

[22] Filed: Sep. 4, 1990

[30] Foreign Application Priority Data

Sep. 5, 1989 [IE] Ireland ..... 2846/89

[51] Int. Cl.[5] ..... G09F 15/00

[52] U.S. Cl. ..... 40/607

[58] Field of Search ..... 40/606, 607, 660, 479, 40/333, 308; 220/691, 682, 680; 292/DIG. 10; 411/910, 908, 907; 248/230, 331.6, 316; 403/335-337

[56] References Cited

U.S. PATENT DOCUMENTS

| | | | |
|---|---|---|---|
| 1,170,036 | 1/1916 | Avery | 220/691 |
| 2,507,875 | 5/1950 | Williams | 40/607 |
| 2,759,281 | 8/1953 | Akers, Jr. | 40/607 |
| 2,946,546 | 7/1960 | Pokorny et al. | 248/230 |
| 3,003,646 | 10/1961 | Wolf | 248/230 |
| 3,391,889 | 7/1968 | Steward, Jr. | 248/230 |
| 3,951,294 | 4/1976 | Wilson | 220/682 |
| 3,986,284 | 9/1976 | Plantinga | 40/607 |
| 4,019,269 | 4/1977 | Vix | 40/660 |
| 4,329,801 | 5/1982 | Clausen | 40/660 |
| 4,372,593 | 2/1983 | Kesselman | 411/910 |
| 4,454,671 | 6/1984 | Morgenstern | 40/607 |
| 4,514,105 | 4/1985 | Adams et al. | 403/337 |
| 4,589,693 | 5/1986 | Kenndy | 411/910 |
| 4,892,430 | 1/1990 | Liska et al. | 403/337 |

FOREIGN PATENT DOCUMENTS

| | | |
|---|---|---|
| 0273022 | 12/1987 | European Pat. Off. . |
| 2208450 | 3/1989 | United Kingdom . |

*Primary Examiner*—Kenneth J. Dorner
*Assistant Examiner*—Cassandra Hope
*Attorney, Agent, or Firm*—Pollock, Vande Sande, & Priddy

[57] ABSTRACT

A display device comprises an elongate member which is formed of two identical moldings and rotatably mounted on two nylon bearings, each of which is secured to a post. One molding is oriented in a first direction and a second molding is oriented in a second opposite direction and the two moldings are engageable in the longitudinal direction. A male rim section of one molding engages in a female rim section of the second molding. Each side of the female rim section has a plurality of supporting lugs which support the male rim section of the other molding when engaged.

13 Claims, 4 Drawing Sheets

DISPLAY DEVICE

FIELD OF THE INVENTION

The present invention relates to a display device, particularly a display device for mounting on a pole such as at a bus stop.

BACKGROUND OF THE INVENTION

It has been noted by many bus companies that in a case where a bus stop is provided with a timetable which indicates the time, it is estimated that a bus will pass that particular stop, thus, usage of the bus and therefore generated fares increase. However, the actual displaying of a timetable at a bus stop does present problems. Prior art signs or displays located at bus stops are likely to cause injury to pedestrians and are also susceptible to being vandalized.

Published United Kingdom Patent Application No. 2214691A of the applicant discloses a display device having means for attachment to a support such as a pole, the display device being cylindrical in shape and having a surface adapted to support and display an information bearing sheet such as a timetable, the display device being co-axial with the pole when attached thereto.

The display device is rotatable about its longitudinal axis and is provided with a domed top and a domed end, whereby no sharp corners or edges are provided on the device.

SUMMARY OF THE INVENTION

The present invention provides a display device of the type described, and further comprises two identical moldings, one molding oriented in a first direction and the second molding oriented in a second opposite direction so as to enable the moldings to engage each other. Each molding having a female rim section and a male rim section, the male and female rim sections of one molding being engageble with the corresponding female and male rim sections respectively of the second molding when orientated in mutually opposite directions, the inner surface of the female rim section having means for support the male rim section of the molding whereby when the two moldings are engaged at the respective rims, the support means prevent the moldings from engaging beyond the rim sections.

Conveniently, the support means comprise a plurality of lugs integrally formed in the molding. Advantageously, one side of the female rim section is provided with a longitudinal bead member whereby when two moldings are engaged, the two longitudinal bead members are aligned to form a single longitudinal strip which covers the engagement line between the two moldings at one side and which divides the outer surface area of the display device. Preferably, each molding is provided with at least one continuous longitudinal strip on its outer surface whereby when two moldings are engaged, the outer surface area of the display device is divided into regions by the longitudinal bead members and the continuous longitudinal strips, each region being adapted to accommodate a poster or other display material.

Advantageously, the moldings are secured in engagement by fastening elements which are located in mountings provided on the inner surface of the molding, each molding having an orifice opening onto the outer surface of the molding, with plugs being provided to seal the orifices after the insertion of the fastening elements into the mountings.

Advantageously, the mountings are located in a region of the molding which allows the plugs to be covered by display material.

Preferably, each plug is provided with a key and each orifice is provided with a corresponding key-way.

Advantageously, the display device includes two dome shaped bearings about which the device may be rotatably mounted, each bearing having means for securing it to a post or pole, with each bearing comprising two identical moldings, each provided with means for engaging to a similar molding.

Conveniently, the engaging means comprises a dowel and orifice arrangement and at least two pairs of corresponding holes for retaining fastening means.

The invention will hereinafter be more particularly described with reference to the accompanying drawings which show, by way of example only, one embodiment of a display device according to the invention. In the drawings:

DETAILED DESCRIPTION OF THE PREFERRED EMBODIMENTS

Figure 1:
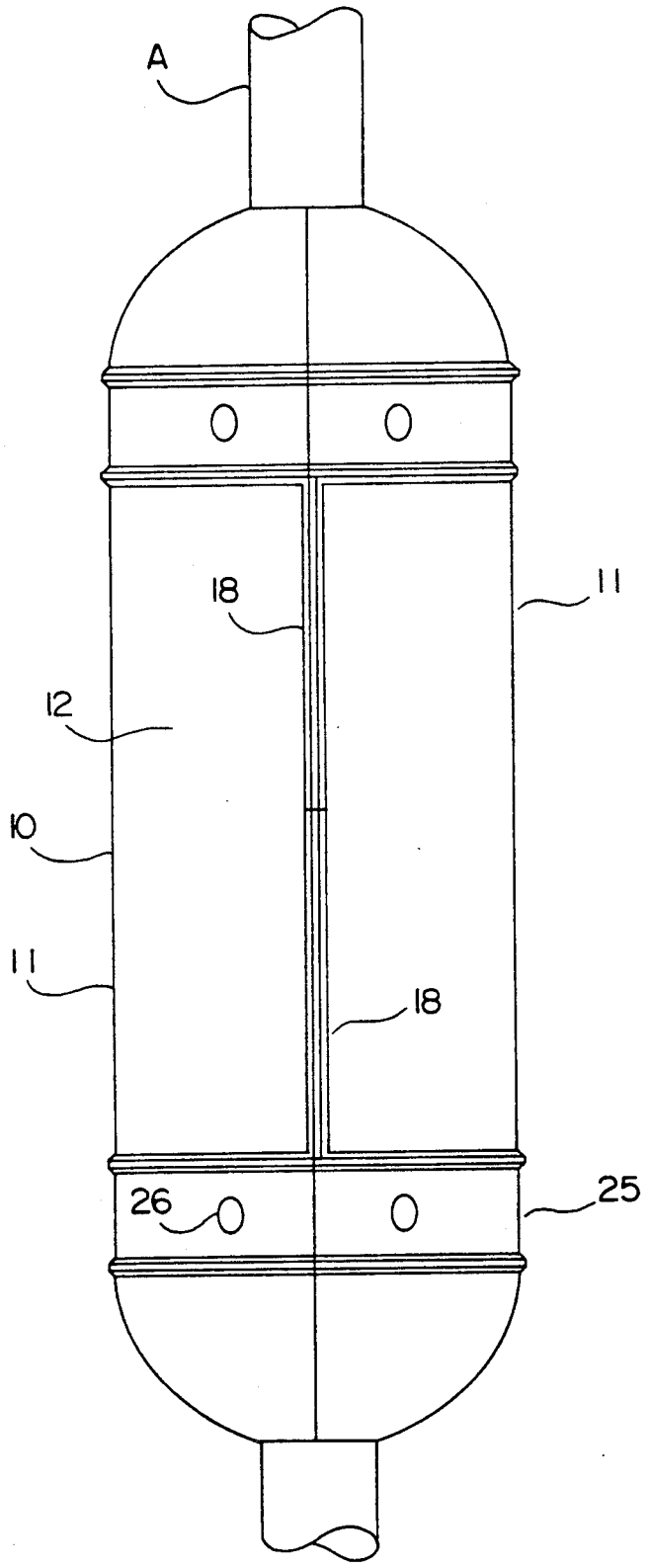
FIG. 1 is a side view of the display device mounted on a pole.
Figure 2:
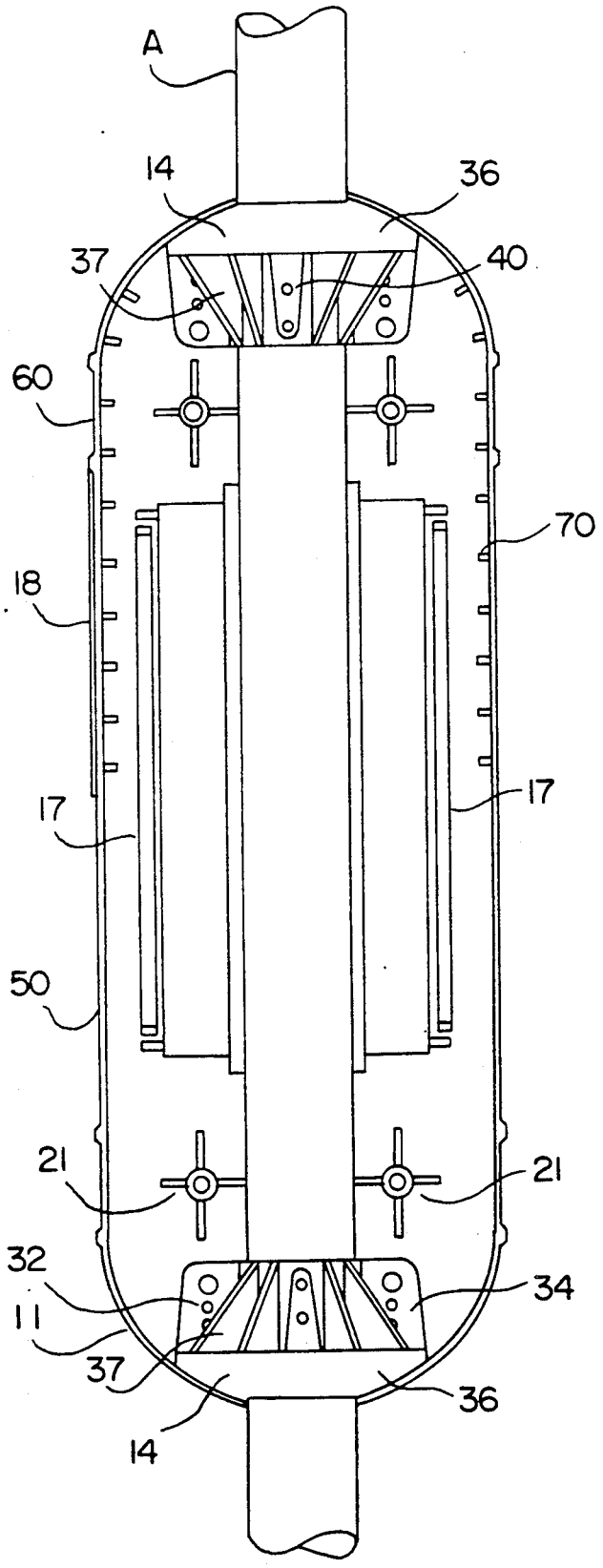
FIG. 2 is a longitudinal cross-sectional view of the display device.
Figure 3:
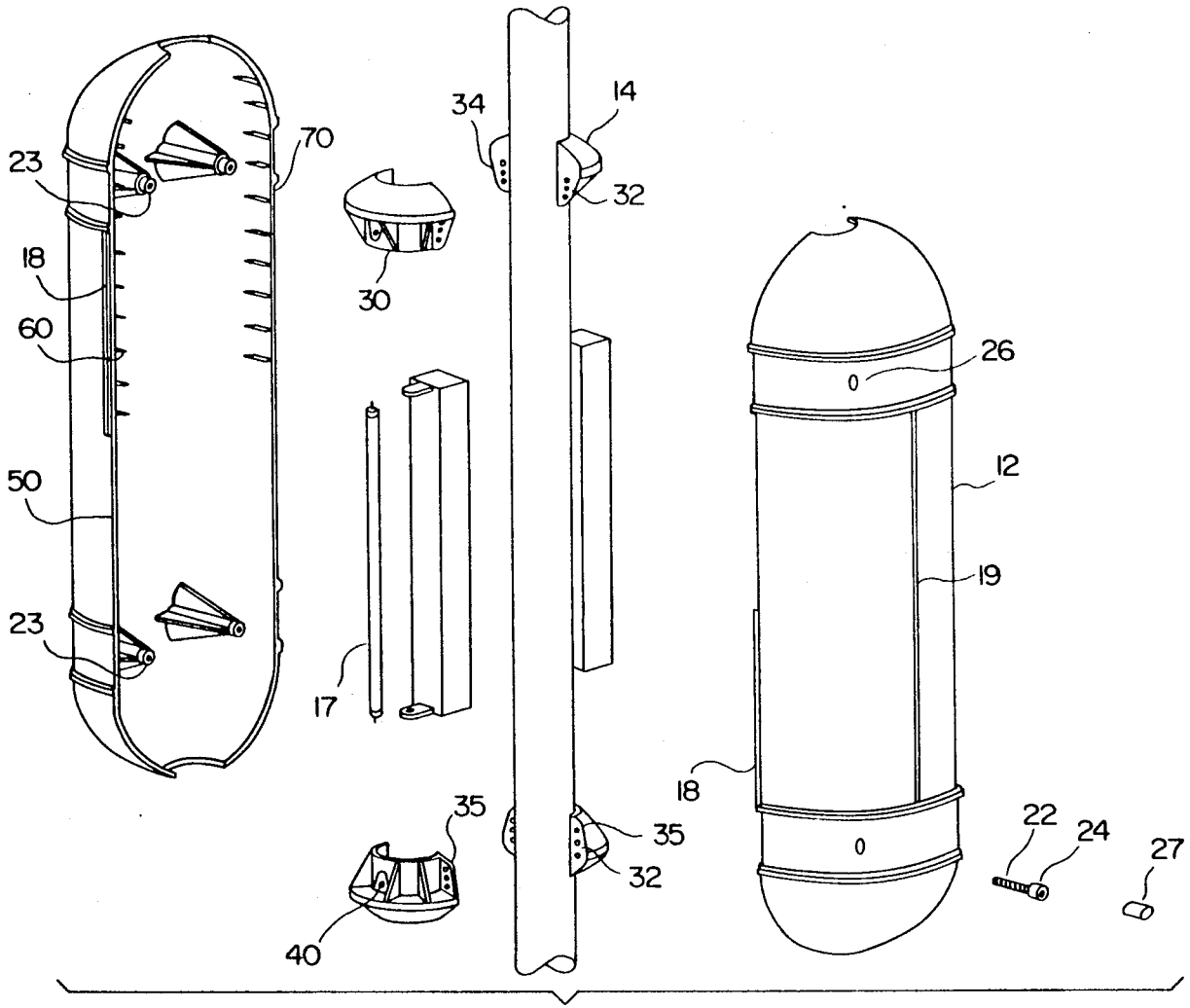
FIG. 3 is an exploded perspective view of the display device and showing how the display device is attached to a pole.
Figure 4:
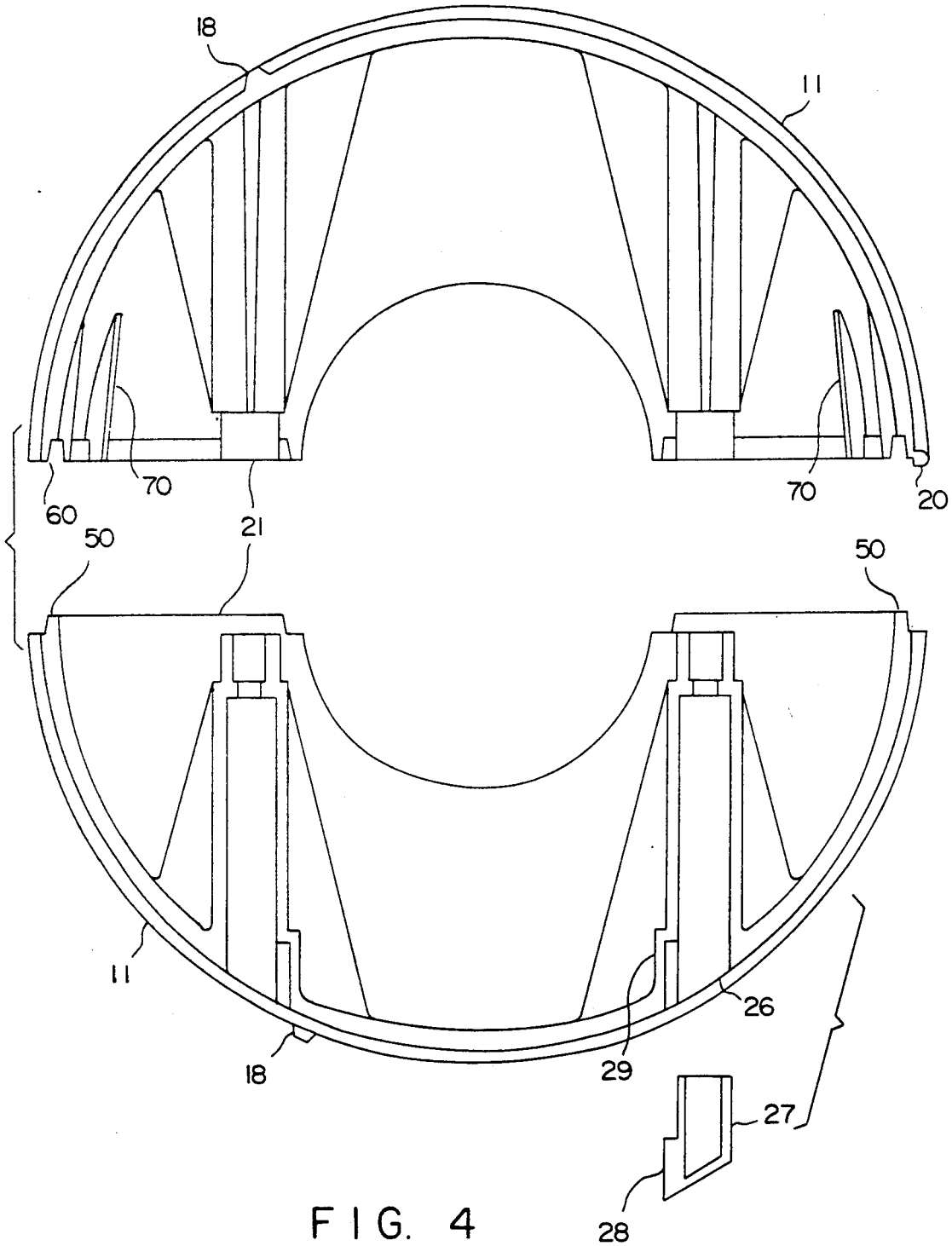
FIG. 4 is a cross-sectional view of two moldings prior to engagement.

Referring to the drawings, the display device comprises a cylindrical drum 10 which is manufactured from two identical moldings 11. The drum 10 is rotatably mounted on two nylon dome-shaped bearings 14 each of which is secured to the pole A by bolts engaging the pole through holes 40. Mounted within the drum 10 and between the bearings 14 are four fluorescent tubes 17 and associated circuitry. The circumference of the drum 10 is divided into three recess panels 12 measuring 375 mm ×250 mm by two integrally formed longitudinal strips 18 and a single longitudinal strip 19 formed by two longitudinal bead members 20, one of each provided on each molding. Four mountings 21 are provided on each molding 11 into which screws 22 and interengaging inserts 23 may be placed. The screws 22 are provided with allen-key heads 24. The holes 26 on the drum are plugged over by means of plugs 27 each having a key 28 which engages in keyway 29.

The moldings 11, which are identical, are injection molded in a polycarbonate derivative and the ends of the drum 10, may be painted as required. The polycarbonate derivative is not susceptible to attack by fluorocarbons as used in aerosols and thus improves the vandal resistance of the display device.

The rim of each molding 11 is provided with a male rim section 50 and a female rim section 60. When a pair of moldings 11 are aligned in mutually opposite directions, the male rim section 50 of one molding 11 engages in the female rim section 60 of the second molding. Each side of the female rim section 60 has ten supporting lugs 70 which support the male rim section 50 of the other molding when engaged.

Each of the dome-shaped bearings 14 comprises a pair of identical moldings 30 which are engaged about the pole. A dowel 32 on each molding fits into a corresponding hole 34. Bolts (not shown) are fitted through mutually aligned holes 35 to tighten the bearing to the pole. Other bolts secure the bearing to the pole A through holes 40. The bearing 14 is manufactured from a nylon material which is self-lubricating and the dome shape corresponds to the dome shape inside molding 11. The dome shape is provided on the upper surface 36 of the bearing and is supported by webs 37.

Information sheets or advertising materials may be secured in the recess panels 12. The information sheets which can have timetables for that particular stop are printed on a matt finish vinyl. The printing is effected by a laser printer. Reflective vinyl strips can be placed in the circumferential panels 25 and cover the plugs 27 from view. As the stop is provides with internal illumination, the bus stop also includes a fuse board, trip switch, control unit, time switch or a solar operated switch, and the like. These elements would usually be provided at a base of the pole and a service door is also required.

The bus stop can include an illuminated sign on top of the pole which can be illuminated so that the bus stop will be clearly visible.

A specific number is allocated to each bus stop, so that a unique timetable may be generated for that bus stop. The identification number may be affixed in a bar coding, so that the number can be read by a bar code reader, for maintenance and servicing.

We claim:

1. A display device rotatably mounted on a support member such as a pole, comprising:

an elongate member having its outer surface adapted for supporting and displaying an information bearing sheet, said elongate member being coaxial with the support member;

said elongate member including a cylindrical portion and top and bottom gradually bending domed portions, said elongate member being entirely formed of two identical parts, which engage with each other along a longitudinal direction of said member;

each part having a male and female rim section which are engageable with complementary rim sections of the other part along said longitudinal direction;

means for interengaging said two identical parts including engaging members provided on an inner surface of said female rim section, said engaging members being spaced along said female rim section, and being engageable with said male rim section; and means for rotatably supporting said elongate member on the support member.

2. A display device according to claim 1, wherein said two parts are made as complementary moldings.

3. A display device according to claim 2, wherein one side of the female rim section is provided with a longitudinal bead member whereby when two moldings are engaged, longitudinal bead members of the two moldings are aligned to form a single longitudinal strip which covers the engagement line between the two moldings at one side and divides an outer surface area of the display device.

4. A display device according to claim 2, wherein said interengaging and supporting means comprise a plurality of lugs integrally formed in the molding.

5. A display device according to claim 1, wherein one side of the female rim section of each molding is provided with a longitudinal bead member whereby when two moldings are engaged, the longitudinal bead members of the two moldings are aligned to form a single longitudinal strip which covers an engagement line between the two moldings at one side and divides the outer surface area of the display device.

6. A display device adapted for attachment to a support member such as a pole, said display device having a surface adapted to support and display an information bearing sheet, said display device being coaxial with the pole and rotatable about its axis, said display device comprising an elongate cylindrical portion and domed top and bottom portions, which are formed of two identical moldings, one molding being oriented in a first direction and the second molding being oriented in a second opposite direction, said moldings being adapted to engage along the longitudinal direction of said device, each molding having a female rim section and a male rim section engageable with the corresponding female and male rim sections of the other molding when oriented in mutually opposite directions, an inner surface of the female rim section having means for interengaging and supporting the male rim section of the second molding, said means including a plurality of engaging members spaced in said longitudinal direction of said device along said female rim section, whereby when the two moldings are engaged at their respective rims, said interengaging and supporting means prevent the moldings from engaging beyond the rim sections.

7. A display device according to claim 6, wherein each molding is provided with at least one continuous longitudinal strip on its outer surface whereby when said two moldings are engaged, an outer surface area of the display device is divided into regions by longitudinal bead members and the continuous longitudinal strips, each region being adapted to accommodate a display material.

8. A display device according to claim 6, wherein said interengaging and supporting means comprise a plurality of lugs integrally formed in the molding.

9. A display device according to claim 6, wherein said moldings are secured in engagement by fastening elements which are located in mountings provided on an inner surface of each molding, each molding having an orifice on an outer surface of the molding, with plugs being provided to seal the orifices after the insertion into said mountings of said fastening elements.

10. A display device according to claim 9, wherein said mountings are located in a region of the molding which allows the plugs to be covered by display material.

11. A display device according to claim 10, wherein each plug is provided with a key and each orifice is provided with a corresponding key-way.

12. A display device according to claim 11, further including two dome-shaped bearings about which the device is rotatably mounted, each bearing having means for securing it to the support member, with each bearing comprising two identical moldings, each provided with means for engaging to a similar molding.

13. A display device according to claim 12, wherein the engaging means comprises a dowel and orifice arrangement and at least two pairs of corresponding holes for retaining fastening means.

* * * * *